US011585124B1

(12) United States Patent
Fickling

(10) Patent No.: US 11,585,124 B1
(45) Date of Patent: Feb. 21, 2023

(54) ANTI-THEFT DEVICE FOR A PACKAGE

(71) Applicant: Jeffry E. Fickling, Mission Viejo, CA (US)

(72) Inventor: Jeffry E. Fickling, Mission Viejo, CA (US)

( * ) Notice: Subject to any disclaimer, the term of this patent is extended or adjusted under 35 U.S.C. 154(b) by 0 days.

(21) Appl. No.: 17/741,683

(22) Filed: May 11, 2022

(51) Int. Cl.
*E05B 73/00* (2006.01)

(52) U.S. Cl.
CPC ..... *E05B 73/00* (2013.01); *E05B 73/0005* (2013.01)

(58) Field of Classification Search
CPC ..... E05B 73/00; E05B 73/0005
See application file for complete search history.

(56) References Cited

U.S. PATENT DOCUMENTS

| | | | | |
|---|---|---|---|---|
| 4,448,049 | A * | 5/1984 | Murray | E05B 73/0005 52/27 |
| 5,699,591 | A * | 12/1997 | Kane | F16G 11/00 24/304 |
| 5,709,110 | A * | 1/1998 | Greenfield | E05B 73/0005 248/553 |
| 6,155,715 | A | 12/2000 | Lake et al. | |
| 7,299,667 | B1 * | 11/2007 | Miresmaili | E05G 1/005 109/51 |
| 8,418,514 | B1 * | 4/2013 | Su | E05B 73/0005 70/57 |
| 9,309,697 | B2 * | 4/2016 | Hoffman | G08B 13/126 |
| 9,364,112 | B2 | 6/2016 | Sundaresan | |
| 9,840,340 | B2 | 12/2017 | O'Toole | |
| 10,143,320 | B1 | 12/2018 | Batts | |
| 10,457,421 | B2 | 10/2019 | O'Toole | |
| 10,743,694 | B2 | 8/2020 | Raphael et al. | |
| 10,769,875 | B2 | 9/2020 | Arellano et al. | |
| 10,842,305 | B1 | 11/2020 | Alcolea | |
| 10,881,235 | B1 | 1/2021 | Vasquez et al. | |
| 11,248,741 | B1 * | 2/2022 | Parniani | A47G 25/0614 |
| 2002/0134119 | A1 * | 9/2002 | Derman | E05B 73/00 70/58 |
| 2006/0086160 | A1 * | 4/2006 | Marszalek | E05B 73/0005 70/58 |
| 2012/0217371 | A1 * | 8/2012 | Abdollahzadeh | G08B 13/1463 248/551 |
| 2017/0280808 | A1 * | 10/2017 | Reda | A42B 3/0413 |

FOREIGN PATENT DOCUMENTS

| | | | | |
|---|---|---|---|---|
| DE | 29611873 | U1 * | 9/1996 | E05B 73/0005 |
| DE | 102010015696 | A1 * | 10/2011 | E05B 67/383 |
| GB | 2424919 | A * | 10/2006 | A47G 29/20 |
| NL | 1035121 | C * | 2/2011 | A45C 13/20 |
| WO | WO-2006095138 | A1 * | 9/2006 | A45C 13/20 |
| WO | WO-2012107707 | A1 * | 8/2012 | A45C 13/20 |

* cited by examiner

*Primary Examiner* — Kimberly T Wood
(74) *Attorney, Agent, or Firm* — Cramer Patent & Design, PLLC; Aaron R. Cramer

(57) ABSTRACT

An anti-theft device for a package is a two-part securing mechanism for packages. The first part is a ball that is attached to the package at the order processing facility. The second part is a matching locking rod with an integral locking mechanism. This locking rod is in turn securely fastened onto a stationary object like a railing, porch post, or other fixed object. The look may be opened by use of a key.

18 Claims, 6 Drawing Sheets

ANTI-THEFT DEVICE FOR A PACKAGE

RELATED APPLICATIONS

None.

FIELD OF THE INVENTION

The present invention relates to an anti-theft device and specifically for an anti-theft package device for a shipped or delivered package.

BACKGROUND OF THE INVENTION

In the typical business day, millions of parcels and items are delivered around the world. While computerized tracking, customer databases, and electronic scanning has greatly increased productivity and reduced mistakes, one weak link remains the final delivery point, as large packages are often simply left on front porches of unattended residences. It is simply not possible to be at home when a package is delivered anymore, as many residences often receive several packages a day.

Unfortunately, the criminal element is always present and such packages are often simply stolen. Package theft is an epidemic, and costs shippers, carriers, and customers several billion dollars annually. Accordingly, there exists a need for a means by which large and oversize parcels can be safely and securely delivered to the intended recipient with reduced opportunity for theft without the recipient being present. The development of anti-theft device for a package fulfills this need.

SUMMARY OF THE INVENTION

The principles of the present invention provide for an anti-theft device that has a locking ball device having an exterior mounting plate adapted to be disposed on an exterior of a package and a slotted tube, a locking rod device connected to the locking ball device, and an attachment ball secured to the exterior mounting plate by a mounting pendant.

The anti-theft device may further comprise a first end of the slotted tube includes a retaining ring, and a second end of the slotted tube may include a locking head with a plurality of wire pins located on its interior attached to the slotted tube along a locking cap travel path. The locking ball device may be pushed down into the locking head, the wire pins may move the sides by use of a multiple tensioning means to travel past the wire pins and allow said wire pins to return to their original position. Once placed upon the slotted tube, the locking head may not be removed without the use of a key. The locking head may allow a delivery personnel to insert the package without removal of the locking head. The exterior mounting plate may have a pair of lobed distal ends and a circular center hub. The exterior mounting plate may be secured to the package with at least 4 mounting pins. The at least 4 mounting pins may each have a self-penetrating tip at their distal end penetrate through the package during installation of the package during a packaging fulfillment process. The self-penetrating tips may have pierced the package and may be each inserted into a matching receiving clip on a backing plate, along an insertion travel path. The locking ball device and the backing plate may remain in place on the package. The exterior mounting plate, the attachment ball, the mounting pendant, and the at least 4 mounting pins may be one-piece. The exterior mounting plate, the attachment ball, the mounting pendant, and the at least 4 mounting pins may be made of a durable material. The durable material may be selected from the group consisting of impact resistant plastic, metal, or fiberglass. The exterior mounting plate may be a triangle shape. The package may be selected from the group consisting of a standard rectangular parallelepiped shape, an envelope, a bag, or a tube. The locking rod device may be adapted to be secured via the retaining ring to a stationary object via a retaining means. The stationary object may be selected from the group consisting of a column, a railing, an eyehook, or other item which is not easily cut, tampered, and/or removed.

The locking rod device may be adapted to be procured and placed by the recipient of the package expected at a certain delivery location. The locking rod device may be adapted to be secured to the stationary object before delivery of the package and may remain in place for subsequent delivery of one or more any following packages. The attachment ball may be adapted to be secured to a center portion of the exterior mounting plate.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. **4*a* is a pictorial view of the internal construction of the locking head, as used with the device, according to the preferred embodiment of the present invention.

DESCRIPTIVE KEY

Figure 1:
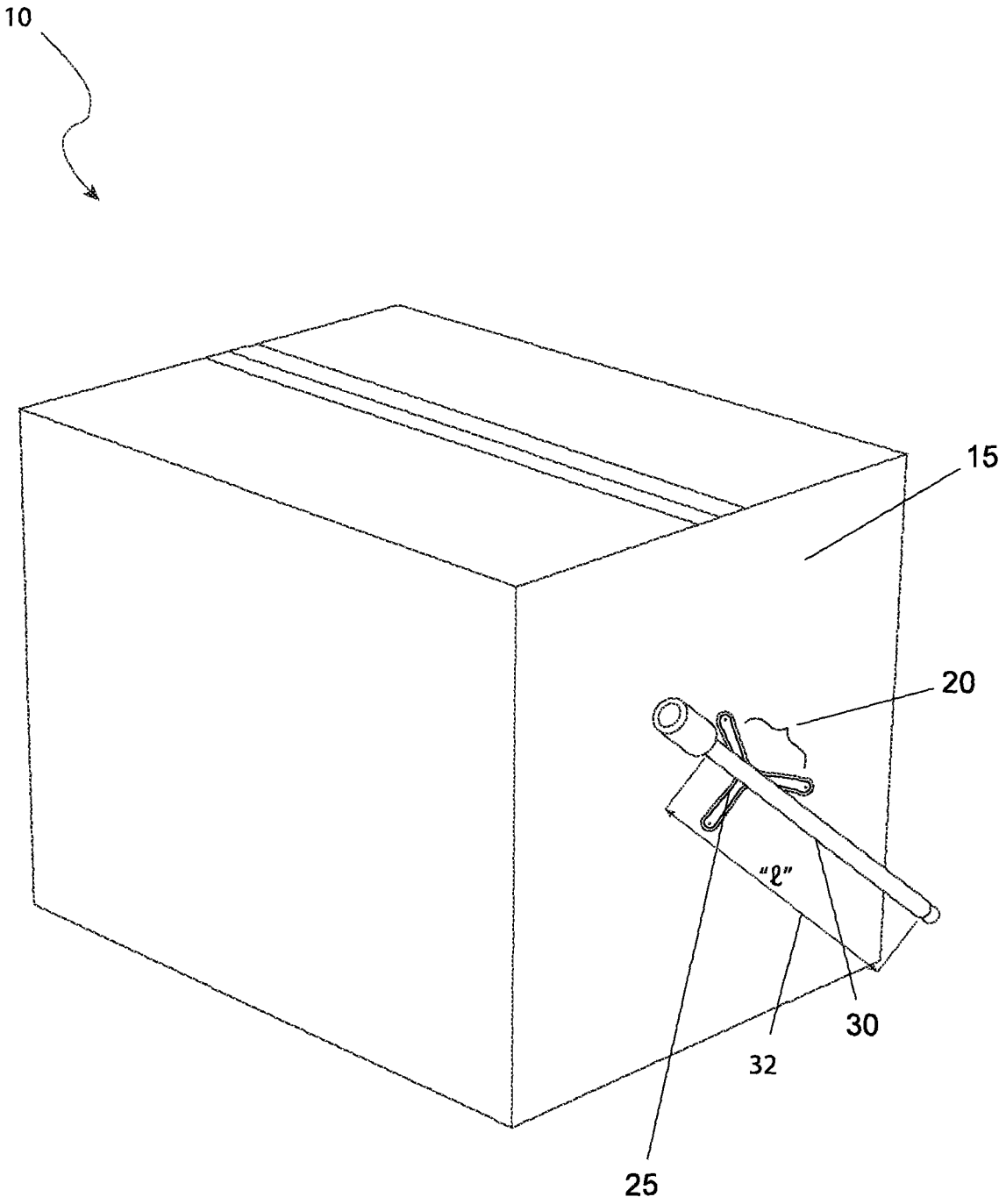
FIG. 1 is a pictorial view of the anti-theft device shown in in an installed state on a package, according to the preferred embodiment of the present invention.

10 anti-theft device
15 package
20 locking ball device
25 exterior mounting plate
30 locking rod device
32 rod device length "l"
35 packaging tape
40 attachment ball
45 mounting pendant
50 mounting pin
55 self-penetrating tip
60 receiving clip
65 backing plate
70 insertion travel path "i"
75 slotted tube
80 retaining ring

85 locking head
90 locking cap travel path "c"
95 slotted opening
100 delivery location
105 porch
110 door
115 stationary object
120 retaining means
125 wire pins
130 tensioning means
135 locking means
140 locking collar

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a pictorial view of an anti-theft device 10, shown in an installed state on a package 15, according to the preferred embodiment of the present invention is disclosed. The anti-theft device (herein also described as the "device") 10, comprises a two-part securing mechanism for a package 15 that is delivered to an unattended delivery location 100. The device 10 includes two (2) primary components. The first is a locking ball device 20, of which an exterior mounting plate 25 is visible, on the exterior of the package 15. The second is a locking rod device 30 which mechanically connects to the locking ball device 20. The rod device length "l" 32 is envisioned to be at least twenty-four inches (24 in.) long. The locking ball device 20 is provided by the shipper of the package 15, while the locking rod device 30 is provided by the recipient of the package 15. Further detail on the configuration and utilization of the locking ball device 20 and the locking rod device 30 will be provided herein below.

Figure 2:
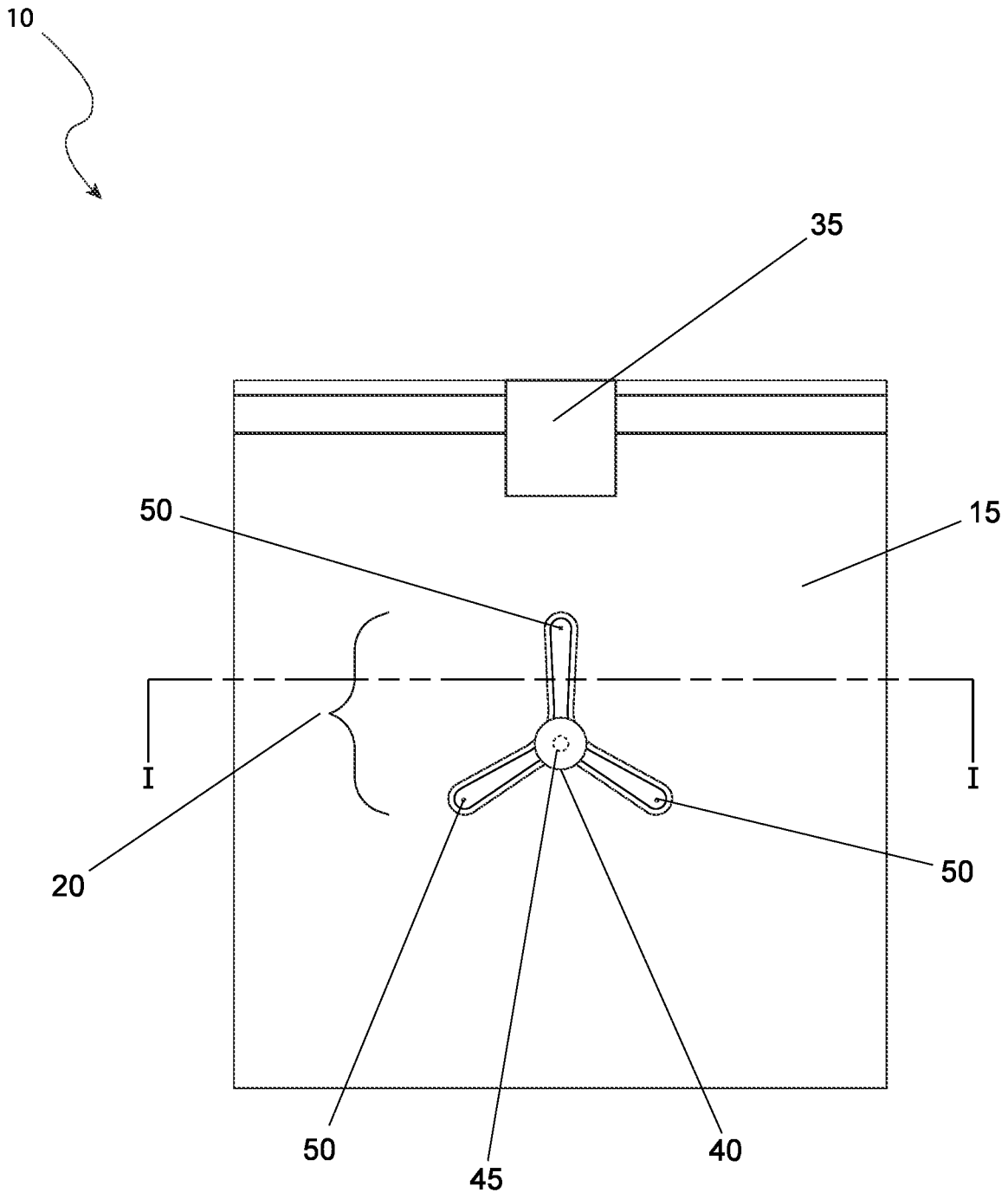
FIG. 2 is a front view of the locking ball device, shown installed upon a package, according to the preferred embodiment of the present invention.

Referring next to FIG. 2, a front view of the locking ball device 20, shown installed upon a package 15, according to the preferred embodiment of the present invention is depicted. The package 15 as depicted in FIG. 2 is depicted by a standard rectangular parallelepiped shape envisioned to made of cardboard and sealed with packaging tape 35. However, other types of shipping packaging such as heavy envelopes, bags, tubes, and the like may also be utilized with the teachings of the present invention. As such, the use of the device 10 with any particular type of package 15 is not intended to be a limiting factor of the present invention. The center of the exterior mounting plate 25 is provided with an attachment ball 40, envisioned to be approximately one-half of an inch to three-quarters of an inch (½-¾ in.) in diameter. The attachment ball 40 is secured to the exterior mounting plate 25 by a mounting pendant 45 (herein depicted by a dashed line due to its hidden nature). In an exemplary embodiment, the exterior mounting plate 25 is shaped as a triangle with lobed distal ends and a circular center hub. The overall length of the mounting pendant 45 is envisioned to be approximately one-quarter of an inch (¼ in.) in length. The exterior mounting plate 25 is secured to the package 15 by use of at least four (4) mounting pins 50. Further detail on the mounting pins 50 will be provided herein below. The exterior mounting plate 25, the attachment ball 40, the mounting pendant 45, and the mounting pins 50 will be made in a one-piece manufacturing process, of a durable material such as impact resistant plastic, metal, fiberglass, or the like, that would resist tampering.

Figure 3:
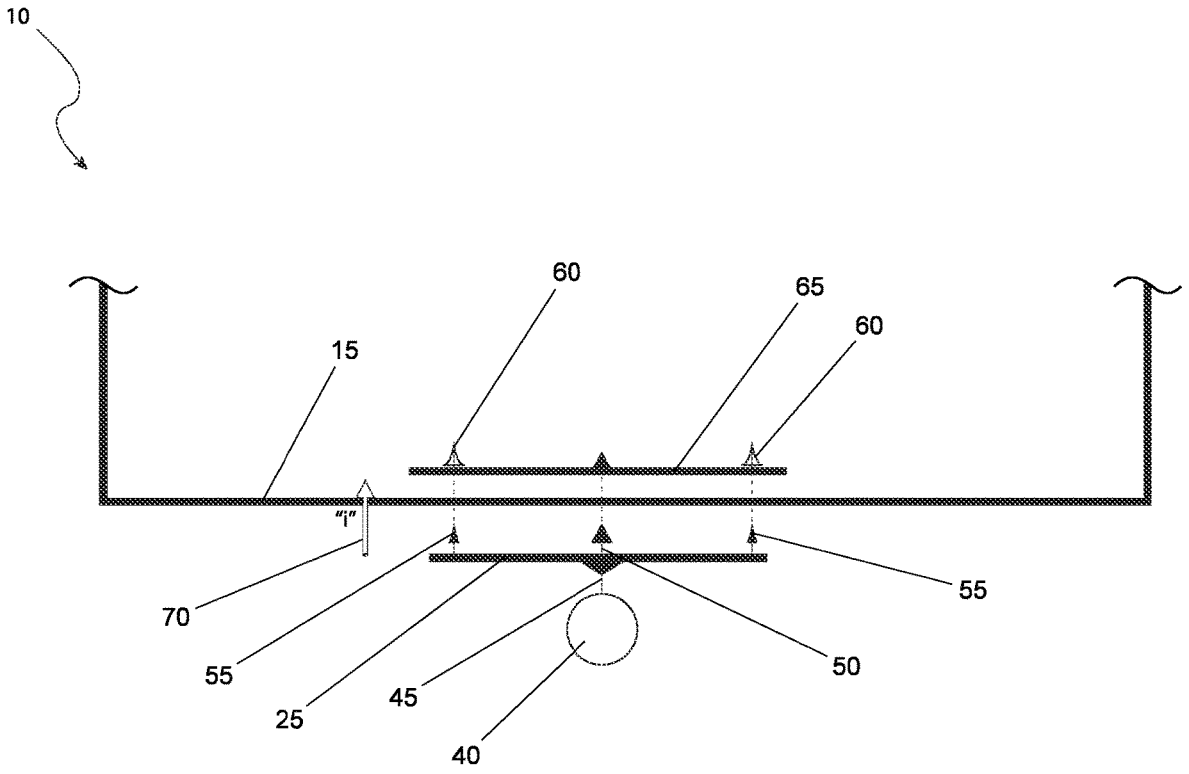
FIG. 3 is a sectional view of the locking ball device as used with the anti-theft device, as seen along a Line I-I, as shown in FIG. 2, according to the preferred embodiment of the present invention.

Referring now to FIG. 3, a sectional view of the locking ball device 20 as used with the anti-theft device 10, as seen along a Line I-I, as shown in FIG. 2, according to the preferred embodiment of the present invention is shown. The attachment ball 40 is physically attached to the exterior mounting plate 25 by use of the mounting pendant 45, as aforementioned described. The mounting pins 50 (of which only three (3) are shown due to illustrative limitations) are provided with self-penetrating tips 55 at their distal end. The self-penetrating tips 55 penetrate through the package 15 during installation of the package 15 during the packaging fulfillment process. Once the self-penetrating tips 55 have pierced the package 15, they are inserted into matching receiving clips 60 on a backing plate 65, along an insertion travel path "i" 70. The receiving clips 60 and the backing plate 65 would be made of the same material as the exterior mounting plate 25. The backing plate 65 may or may not be coextensive in size and shape of the exterior mounting plate 25. The number of receiving clips 60 should match the number of mounting pins 50. Should a recipient of a package 15 desire the protective services of the device 10, the shipper would attach the locking ball device 20, including the backing plate 65 during packaging of the package 15, whereupon it remains in place for the duration of the life of the package 15.

Figure 4:
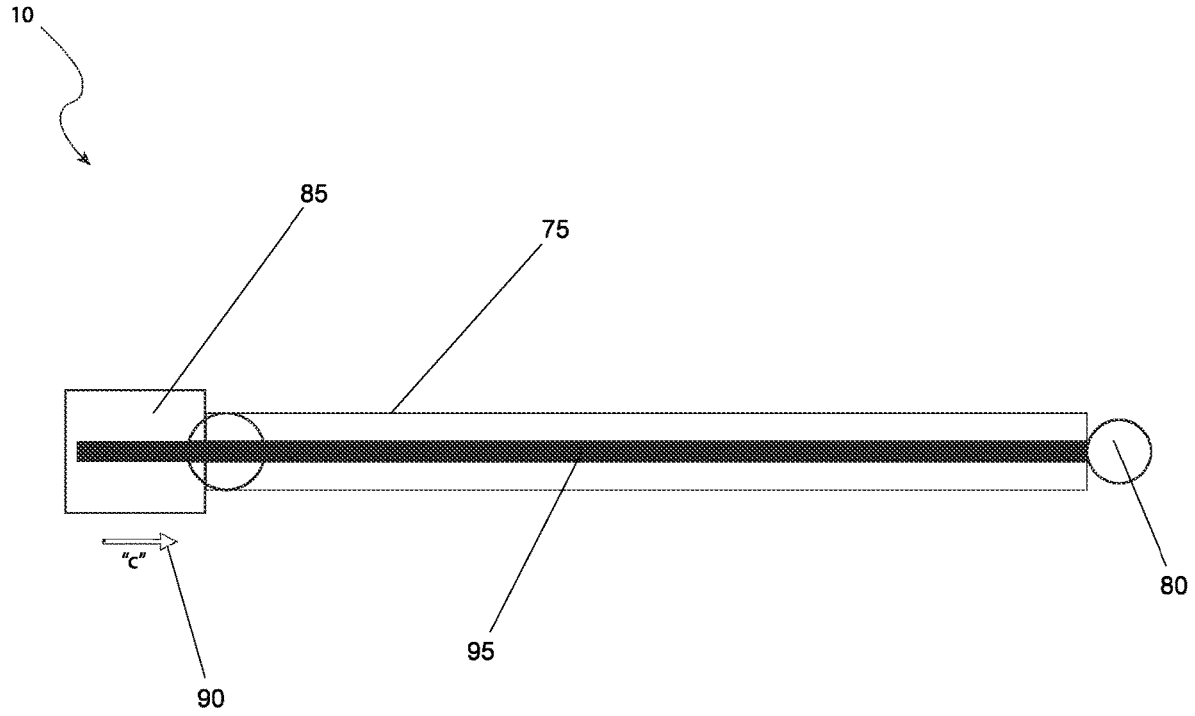
FIG. 4 is a side view of the locking rod device, as used with the anti-theft device, according to the preferred embodiment of the present invention.

Referring next to FIG. 4, a side view of the locking rod device 30, as used with the device 10, according to the preferred embodiment of the present invention is disclosed. The primary component of the locking rod device 30 is a slotted tube 75. A first end of the slotted tube 75 is provided with a retaining ring 80, whose functionality will be described herein below. The opposite second end of the slotted tube 75 is provided with a locking head 85 which physically attached to the slotted tube 75 along a locking cap travel path "c" 90. Once placed upon the slotted tube 75, the locking head 85 cannot be removed without the use of a key. The locking head 85 allows delivery personnel to insert the package 15 (as shown in FIG. 1) without removal of the locking head 85. The delivery personnel thus secures the package 15 in place. Further detail on the internal construction of the locking head 85 will be provided herein below.

Figure 4A:
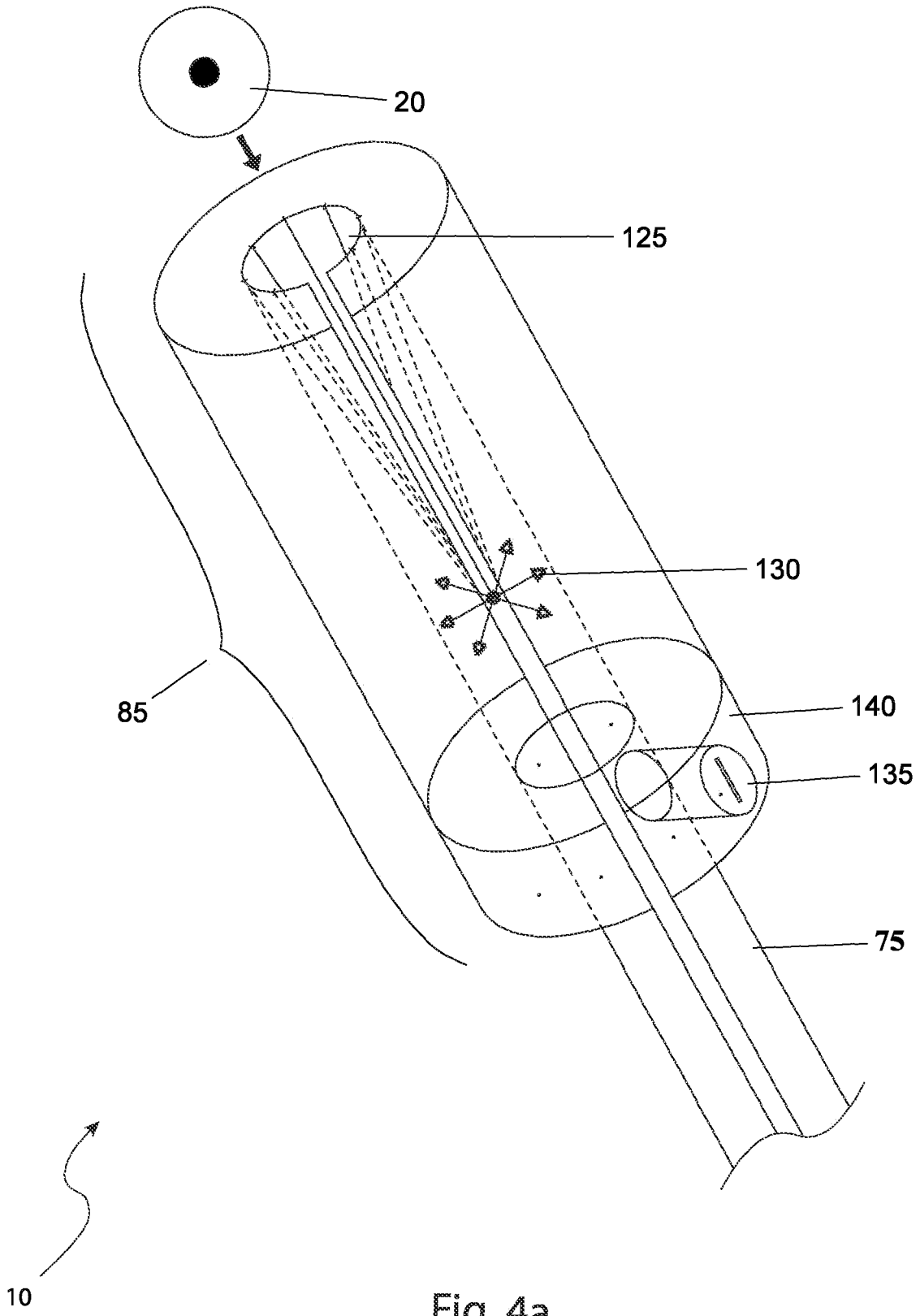

Referring to FIG. 4*a*, a pictorial view of the internal construction of the locking head 85, as used with the device 10 is depicted. The locking head 85 is a cylindrical-shaped device with seven (7) wire pins 125 located on its interior. When the locking ball device 20 is pushed down into the locking head 85, the wire pins 125 move the sides by use of multiple tensioning means 130 such as springs or elastic bands. This action allows the locking ball device 20 to travel past the wire pins 125 and allow said wire pins 125 to return to their original position. This feature allows for one or more of the locking ball devices 20 to be inserted without removal of the locking head 85. An authorized user may then remove the locking head 85 via a locking means 135 such as a key lock (as illustrated in the exemplary embodiment), combination lock, electronic lock, or the like located upon a locking collar 140. Once removed, the locking head 85 is replaced to allow for future use of the locking rod device 30 to secure future packages 15.

Figure 5:
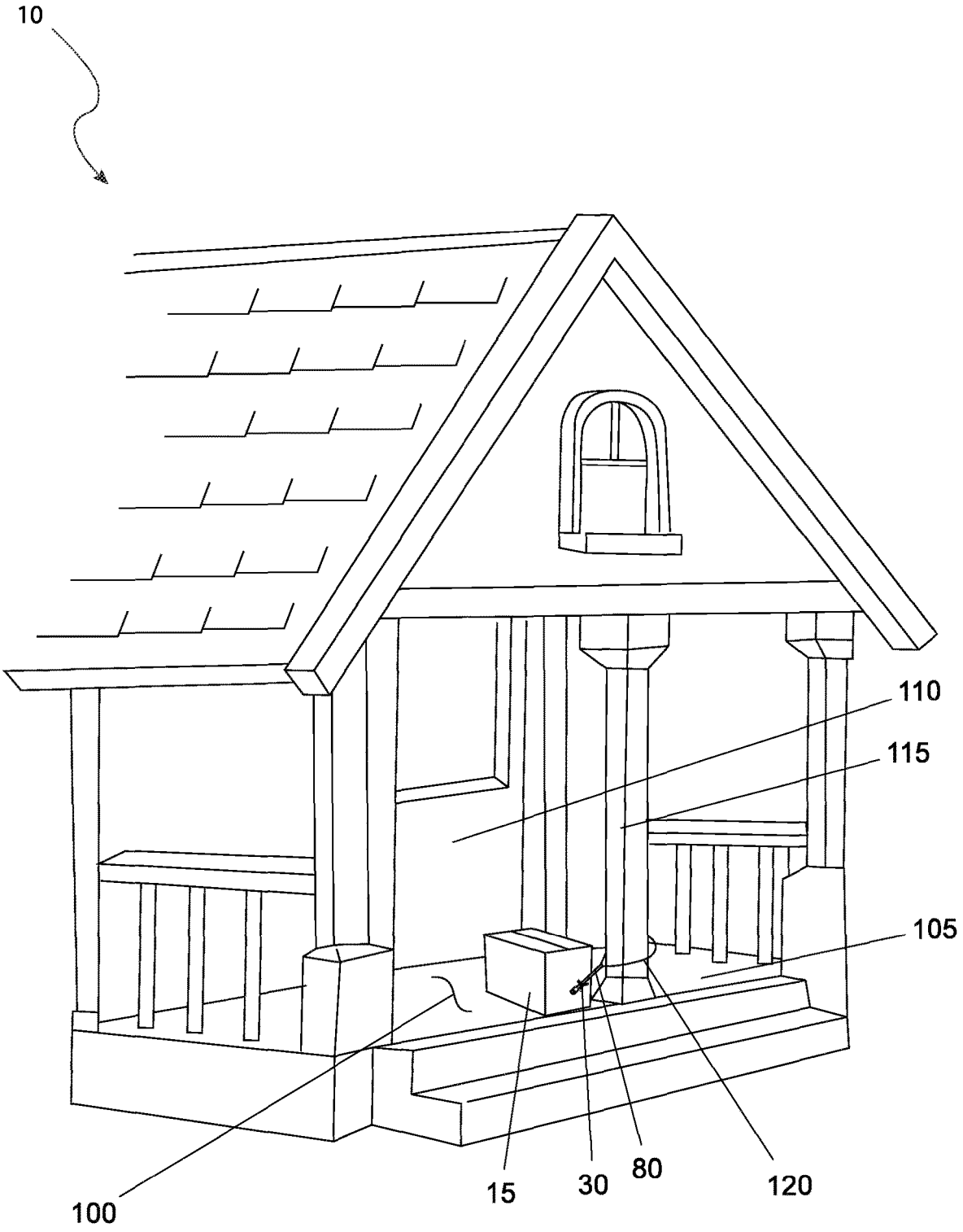
FIG. 5** is a perspective view of the anti-theft device, shown in a utilized state in a delivery location, according to the preferred embodiment of the present invention.

Referring to FIG. 5, a perspective view of the device for unattended packages 10, shown in a utilized state in a delivery location 100, according to the preferred embodiment of the present invention is depicted. The delivery location 100 is depicted as a porch 105 with a door 110. However, other delivery areas 100, typically unattended, such as a side door, garage, vestibule, stairway, or the like may also be used with the teachings of the present invention. The locking rod device 30 is secured via the retaining ring 80 to a stationary object 115 via a retaining means 120. The stationary object 115 is envisioned to be a column, railing, eyehook, or other item which is not easily cut, tampered, and/or removed. The retaining means 120 is envisioned to be a chain, metal cable, reinforced plastic cable, or the like. The flexible nature of the retaining means 120 allows for easy movement of the locking rod device 30 to accommodate different sizes and configurations of package 15. As aforementioned described, the locking rod device 30 is procured and place by the recipient of the package 15 expected at a certain delivery location 100. The locking rod device 30 is secured to the stationary object 115 before delivery of the first package 15 and will remain in place for subsequent delivery of any following packages 15.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the locking rod device 30 portion of the device 10 from conventional procurement channels such as hardware stores, home improvement stores, discount stores, department stores, mail order and internet supply houses and the like.

After procurement and prior to utilization, the device 10 would be prepared in the following manner: the locking rod device 30 portion would be secured to a stationary object 115 at the intended delivery location 100 using the retaining means 120 through the retaining ring 80 and any well-known retaining method such as a lock, one-time crimp connector, cable clamp, or the like. During ordering of any package 15 with a likelihood of theft, the user would request that the package 15 be provided with a locking ball device 20, perhaps at an additional charge. During fulfillment and packing of the package 15, the exterior mounting plate 25 would be joined to the backing plate 65 using the self-penetrating tips 55 of the mounting pins 50, with the attachment ball 40 at an easily accessible location on the exterior of the package 15. Shipment of the package 15 then occurs following conventional delivery methods.

During delivery of the package 15, the delivery personnel would secure the attachment ball 40 of the locking ball device 20 into the slotted opening 95 on the slotted tube 75; without removal of the locking head as described in FIG. 4 thus completing the delivery of the package 15. Upon arrival at the delivery location 100, the recipient of the package 15 would remove the locking head 85 using a key or other authorized method of unlocking in the locking means 135 the package 15 is removed from the locking rod device 30, the locking head 85 is replaced for future use, and the opening of the package 15 occurs in a normal fashion.

After use of the device 10, the locking rod device 30 including the slotted tube 75, the locking head 85 and the retaining means 120 remain in place for future package delivery. The original package 15, along with the locking ball device 20 including the exterior mounting plate 25, the backing plate 65, and the attachment ball 40 is simply discarded using pertinent recycling and/or refuse elimination methods. Future delivery of any additional packages 15 follow the above-mentioned process in a repeating fashion.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An anti-theft device, comprising:

a locking ball device having an exterior mounting plate adapted to be disposed on an exterior of a package;

a locking rod device having a slotted tube;

an attachment ball secured to the exterior mounting plate by a mounting pendant; and a first end of the slotted tube having a retaining ring and a second end of the slotted tube having a locking head with a plurality of wire pins located on a locking head interior attached to the slotted tube along a locking cap travel path.

2. The anti-theft device, according to claim 1, wherein the locking ball device is pushed down into the locking head, the wire pins move a plurality of locking head sides by use of a multiple tensioning means to travel past the wire pins and allow said wire pins to return to an original position.

3. The anti-theft device, according to claim 1, wherein once placed upon the slotted tube, the locking head cannot be removed without a key.

4. The anti-theft device, according to claim 1, wherein the locking head allows a delivery personnel to insert the package without removal of the locking head.

5. The anti-theft device, according to claim 1, wherein the exterior mounting plate is secured to the package with at least 4 mounting pins.

6. The anti-theft device, according to claim 5, wherein the at least 4 mounting pins each having a self-penetrating tip at a distal end to penetrate through the package during installation of the package during a packaging fulfillment process.

7. The anti-theft device, according to claim 6, wherein the self-penetrating tips have pierced the package and are each inserted into a matching receiving clip on a backing plate, along an insertion travel path.

8. The anti-theft device, according to claim 7, wherein the locking ball device and the backing plate remain in place on the package.

9. The anti-theft device, according to claim 5, wherein the exterior mounting plate, the attachment ball, the mounting pendant, and the at least 4 mounting pins are one-piece.

10. The anti-theft device, according to claim 5, wherein the exterior mounting plate, the attachment ball, the mounting pendant, and the at least 4 mounting pins are made of a durable material.

11. The anti-theft device, according to claim 10, wherein the durable material is selected from the group consisting of impact resistant plastic, metal, or fiberglass.

12. The anti-theft device, according to claim 1, wherein the exterior mounting plate has a triangle shape.

13. The anti-theft device, according to claim 1, wherein the package is selected from the group consisting of a standard rectangular parallelepiped shape, an envelope, a bag, or a tube.

14. The anti-theft device, according to claim 1, wherein the locking rod device is adapted to be secured via the retaining ring to a stationary object via a retaining means.

15. The anti-theft device, according to claim 14, wherein the stationary object is selected from the group consisting of a column, a railing, an eyehook, or other item which is not easily cut, tampered, or removed.

16. The anti-theft device, according to claim 1, wherein the locking rod device is adapted to be procured and placed by a recipient of the package expected at a delivery location.

17. The anti-theft device, according to claim 16, wherein the locking rod device is adapted to be secured to a stationary object before delivery of the package and will remain in place for subsequent delivery of said package.

18. The anti-theft device, according to claim 1, wherein the attachment ball is adapted to be secured to a center portion of the exterior mounting plate.

* * * * *